US006966809B2

(12) United States Patent
Urabe

(10) Patent No.: US 6,966,809 B2
(45) Date of Patent: Nov. 22, 2005

(54) AIR SUPPLY AND EXHAUST SYSTEM FOR BUOYANCY COMPENSATOR

(75) Inventor: Seishiro Urabe, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/954,241

(22) Filed: Oct. 1, 2004

(65) Prior Publication Data

US 2005/0075018 A1 Apr. 7, 2005

(30) Foreign Application Priority Data

Oct. 7, 2003 (JP) ..... 2003-348867

(51) Int. Cl.[7] ..... B63C 9/15
(52) U.S. Cl. ..... 441/96; 405/186
(58) Field of Search ..... 441/88, 92, 96; 405/185, 186, 193; 128/202.14

(56) References Cited

U.S. PATENT DOCUMENTS 4,523,914 A * 6/1985 Faulconer et al. ..... 441/88
5,707,177 A * 1/1998 Lehrer et al. ..... 405/186
5,788,415 A * 8/1998 Chen ..... 405/186
5,823,713 A * 10/1998 Biran ..... 405/186
6,039,043 A * 3/2000 Graber et al. ..... 128/202.14
6,722,819 B2 * 4/2004 Godoy ..... 405/186

FOREIGN PATENT DOCUMENTS

JP 1995-71957 8/1995

* cited by examiner

*Primary Examiner*—Lars A. Olson
(74) *Attorney, Agent, or Firm*—Clark & Brody

(57) ABSTRACT

An air supply and exhaust system used for a buoyancy compensator includes an air supply and exhaust unit attached to a jacket, a manipulating unit connected to a hose extending from an air cylinder and first and second hoses connected to these two units. The air supply and exhaust unit uses the air supplied from the manipulating unit to supply the air to the jacket and to open an air exhaust valve and thereby to exhaust the air from the jacket. The manipulating unit uses a rotary change-over switch to supply the air from an air cylinder to a main supply pipe or an air chamber of the air supply and exhaust unit.

3 Claims, 10 Drawing Sheets

AIR SUPPLY AND EXHAUST SYSTEM FOR BUOYANCY COMPENSATOR

BACKGROUND OF THE INVENTION

The present invention relates to an air supply and exhaust system suitable for use in a buoyancy compensator carried by a diver.

Japanese Patent Application Publication No. 1995-71957 (Citation) discloses a buoyancy compensator for diving in which an exhaust valve assembly is attached to an air supply opening provided on a shoulder of the buoyancy compensator and an exhaust valve of this assembly is opened by an air flow introduced from a power inflator to exhaust the air from the buoyancy compensator.

In the buoyancy compensator disclosed in Citation, the power inflator is provided with an exhaust button and an inflator button side by side which are properly used for air supply to or air exhaust from the buoyancy compensator. For proper use of these two buttons, a driver may be required to be more or less skillful. An additional problem may occur due to the arrangement of this buoyancy compensator such that the air used to open the exhaust valve is supplied by an inner hose extending within a bellows-type outer hose. More specifically, this inner hose is connected to the exhaust valve within the bellows-type outer hose and therefore it may be often difficult to detect any abnormality occurring in various regions such as a region along the inner hose itself or a region in which the inner hose is connected to the exhaust valve.

SUMMARY OF THE INVENTION

In view of the problems as have been described above, it is an object of the present invention to provide a buoyancy compensator using the air supplied from the air cylinder to open the exhaust valve attached to the air bag improved so that an operation of opening the exhaust valve may be simplified and a checking of the air supply and exhaust system for opening of the exhaust valve may be facilitated.

The object set forth above is achieved, according to the present invention, by an air supply and exhaust system attached to an air bag of a buoyancy compensator, and comprising an air supply and exhaust unit adapted to control of air supply from an air supply source connected to the buoyancy compensator to the air bag and to control air exhaust from the air bag by opening or closing an air exhaust valve and a manipulating unit adapted to control the air exhaust valve to be opened or closed.

The air supply and exhaust system further comprises the following.

The air supply and exhaust unit is attached to a periphery of an air supply and exhaust opening formed in the air bag and comprises a main air supply pipe fixed to the air bag in air-communication with the interior of the air bag and an air exhaust valve provided closely around an outer peripheral surface of the main air supply pipe so as to be pressed under a biasing effect of a spring against a valve seat formed around the main air supply pipe wherein the air exhaust valve includes a slide member adapted to slide along the outer peripheral surface against the biasing effect of the spring so that the air exhaust valve may be moved apart from the valve seat and thereby to allow for air exhaust from the air bag, and the manipulating unit is adapted to be connected with an air hose extending from the air supply source and comprises a first air supply pipe connected to the main air supply pipe, a second air supply pipe connected to an air chamber formed between the main air supply pipe and the slide member and a rotary change-over switch functioning to change-over a direction of the air flow wherein a rotational position of the change-over switch may be selected to direct the air flow to any one of the first air supply pipe and the second air supply pipe or to interrupt the air flow to these first and second air supply pipes and, in this way, the manipulating unit allows the air to be supplied to the air chamber through the second air supply pipe and thereby allows the slide member to slide against the biasing effect of the spring under a pressure of the air.

In the air supply and exhaust system according to this embodiment, position-selection of the rotary change-over switch makes it possible to supply the air into the air bag or to exhaust the air from the air bag and correspondingly facilitates manipulation of air supply and exhaust. The air supply and exhaust unit and the manipulating unit are connected to each other via the main air supply pipe and the first air supply pipe which are independent from each other. Such unique arrangement facilitates these air supply pipes to be checked.

According to one preferred embodiment of the present invention, the manipulating unit comprises first and second vent channels extending in parallel to each other and first and second joint channels connected to these two vent channels in air-communicating relationship and extending in parallel to each other wherein the first vent channel is formed so as to be connected to the air hose, an intermediate section of the first vent channel defined between its positions at which the first vent channel is connected to the first and second joint channels, respectively, is connected to the first air supply pipe and an intermediate section of the second vent channel defined between its positions at which the second vent channel is connected to the first and second joint channels, respectively, is connected to the second air supply pipe; the first vent channel contains therein first and second valves adapted to be alternately opened and closed wherein the first valve is interposed between the first joint channel and the first air supply pipe and normally closed to block the air flow from the air hose into the first air supply pipe while the second valve is interposed between the second joint channel and the first air supply pipe and normally opened to connect the second joint channel with the first air supply pipe in air-communicating relationship via the first vent channel; the second vent channel contains therein third and fourth valves adapted to be alternately opened and closed wherein the third valve is interposed between the first joint channel and the second air supply pipe and normally closed to block the air flow from the air hose into the second air supply pipe while the fourth valve is interposed between the second joint channel and the second air supply pipe and normally opened to connect the second joint channel with the second air supply pipe in air-communicating relationship via the second vent channel; and the change-over switch can be selectively set to a first position at which the second valve is closed, a second position at which the fourth valve is actuated and a neutral third position at which these two valves are left in normal states thereof.

In the air supply and exhaust system according to this embodiment, it is possible to connect the first vent channel of the manipulating unit to the main air supply pipe provided in the air supply and exhaust unit in air-communicating relationship and thereby to the air from the air hose to the air bag via the main air supply pipe.

According to another preferred embodiment of the present invention, the change-over switch is normally set to the third position under the biasing effect of the spring and may be selectively set to any one of the first position and the second position against the biasing effect of the spring.

In the air supply and exhaust system according to this embodiment, the change-over switch is spring-biased to be normally set to the neutral third position, so any manipulation of the change-over switch is not required after manipulation for air supply or air exhaust.

DETAILED DESCRIPTION OF THE PREFERRED EMBODIMENTS

Details of the an supply and exhaust system according to the present invention will be more fully understood from the description given hereunder with reference to the accompanying drawings.

Figure 1:
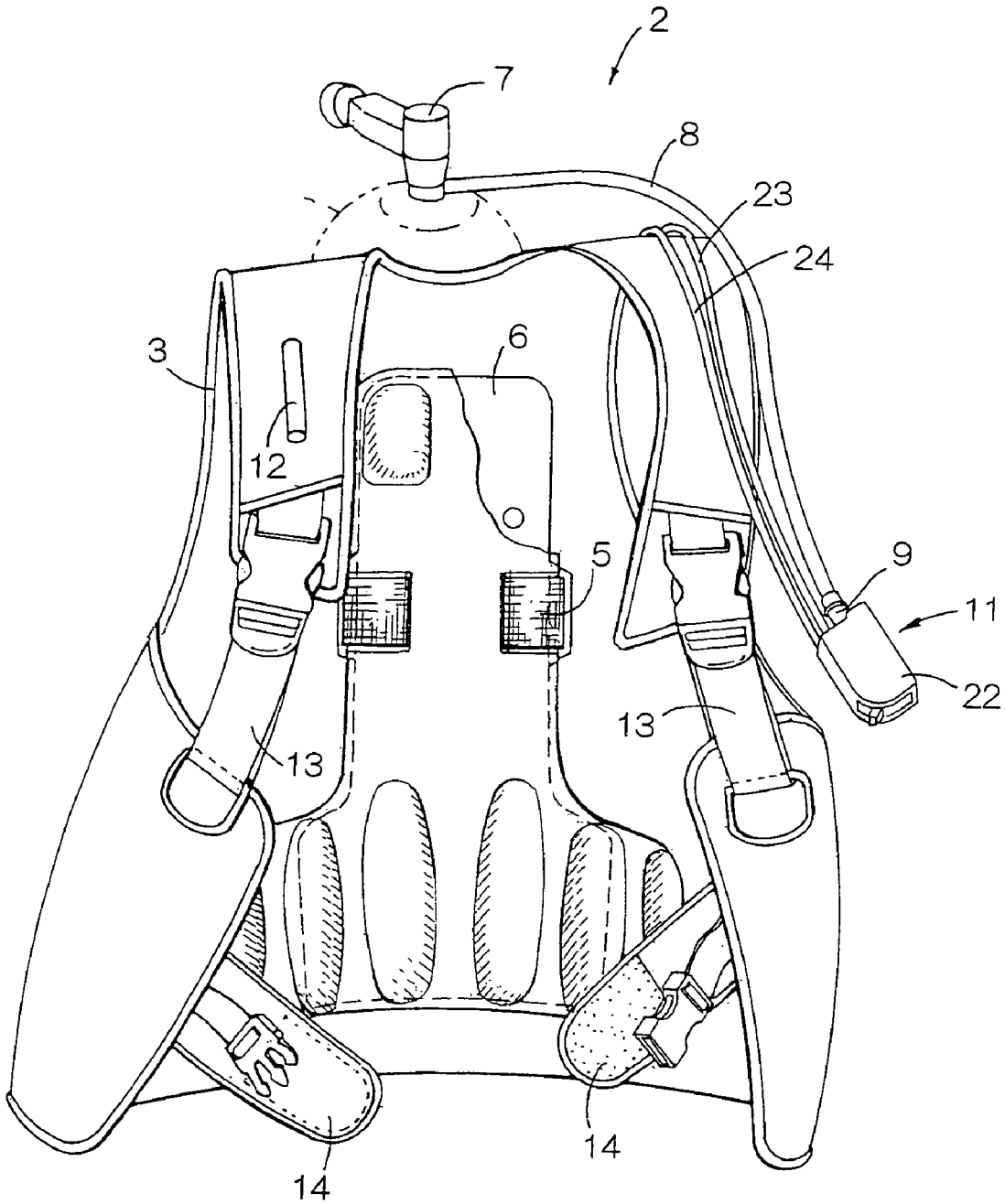
FIG. 1 is a front view of a buoyancy compensator according to the present invention.
Figure 2:
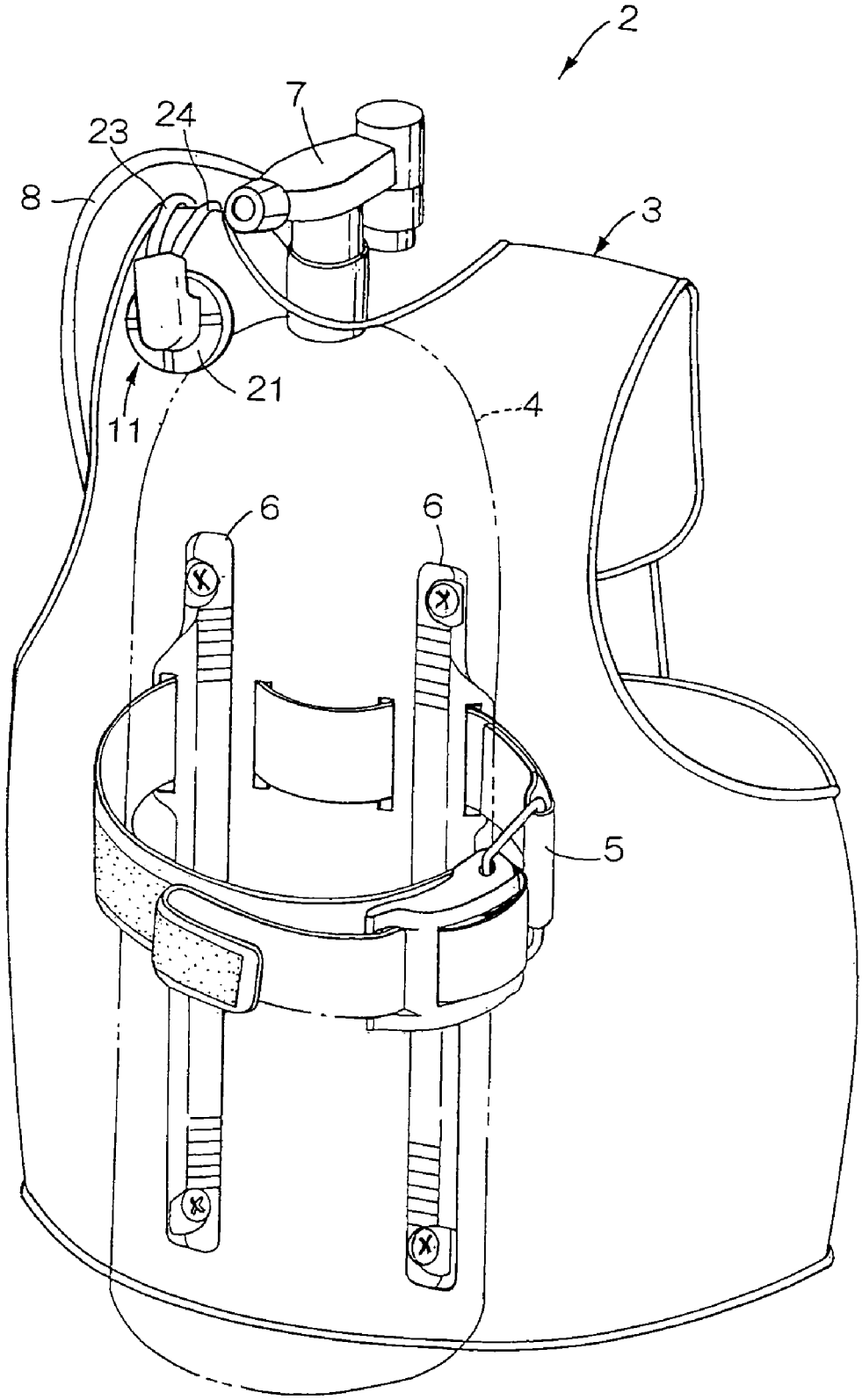
FIG. 2 is a rear view of the buoyancy compensator.

FIGS. 1 and 2 are front and rear views, respectively, of a buoyancy compensator 2 using an air supply and exhaust system. The buoyancy compensator 2 comprises a jacket 3 serving also as an air bag, a harness 6 to which an air cylinder is fastened by means of a belt 5, a pressure reducing valve 7 attached to the air cylinder 4 indicated by imaginary lines, an air hose 8 extending from the pressure reducing valve 7 and the air supply and exhaust system 11 attached to the air hose 8 by means of a coupler 9. The air supply and exhaust system 11 comprises an air supply and exhaust unit 21 attached to a left shoulder of the jacket 3, a manipulating unit 22 connected to the air hose 8 and first and second hoses 23, 24 extending between the air supply and exhaust unit 21 and the a manipulating unit 22.

Figure 3:
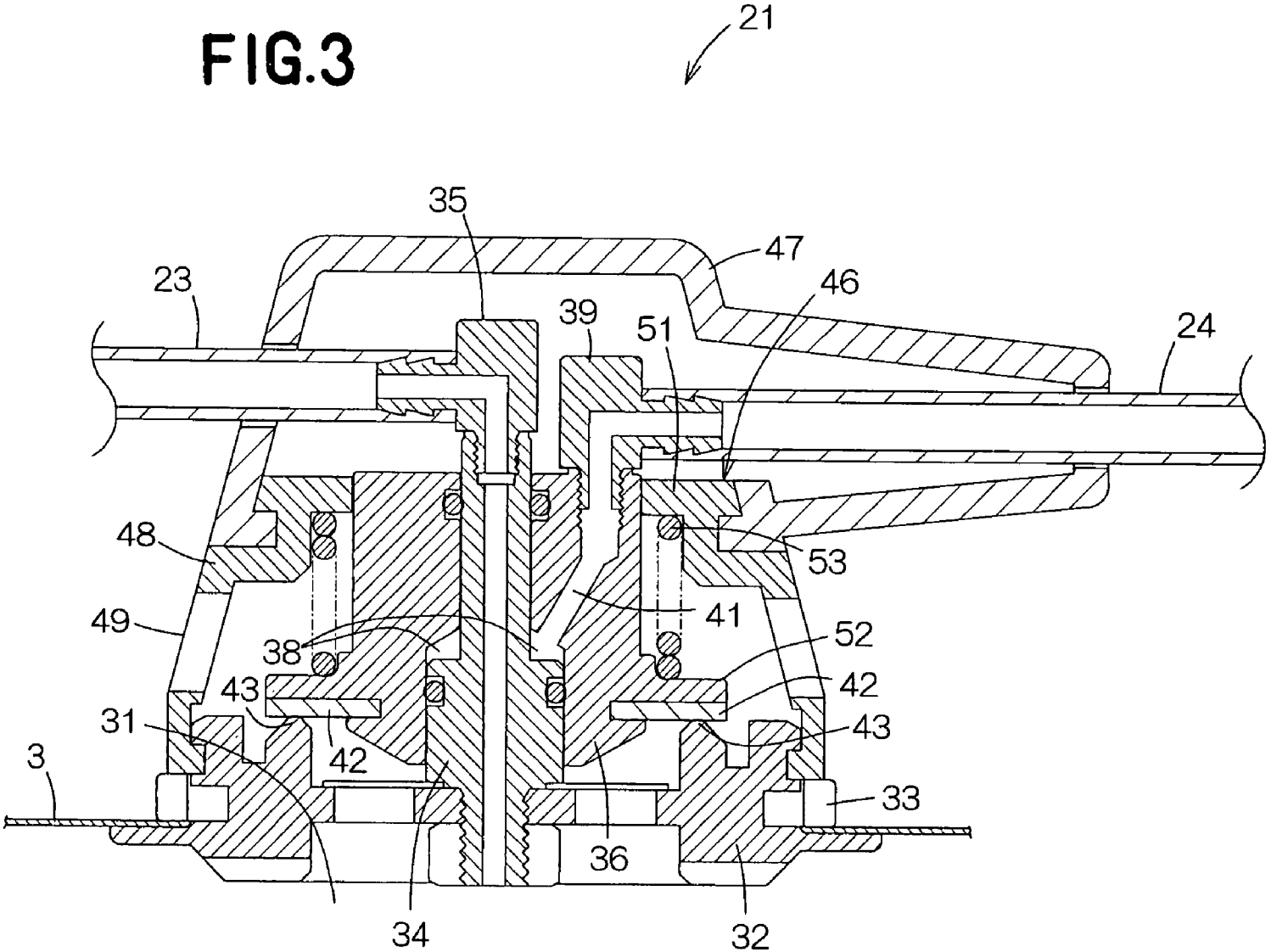
FIG. 3 is a sectional view of an air exhaust unit.

FIG. 3 is a sectional view of the air supply and exhaust unit 21. It should be understood here that the first and second hoses 23, 24 really extending in one and same direction are illustrated to extend in opposite directions for better understanding of the structure. The air supply and exhaust unit 21 is fixed to a periphery of an air supply and exhaust opening 31 formed in the jacket 3 by means of a first attachment 32 and a second attachment 33. A lower end of a main air supply pipe 34 is fixed to the first attachment 32 and opened into the jacket 3. The first hose 23 serving as a first air supply pipe is connected to an upper end of the main air supply pipe 34 by means of a connector member 35. An annular slide member 36 is provided around the main air supply pipe 34 so that this annular slide member 36 is slidable along an outer peripheral surface of the main air supply pipe 34 in vertical direction. An air chamber 38 is defined between the main air supply pipe 34 and the slide member 36. The slide member 36 is formed with an air flow channel 41 extending the air chamber 38 to a connector member 39 attached to a top of the slide member 36 and the second hose 24 serving as a second air supply pipe is connected to the connector member 39. An annular air exhaust valve 42 is attached to a lower part of the slide member 36 and adapted to bear against an annular valve seat 43. A cover member 46 and a cap 47 are provided around the slide member 36. The cover member 46 has its lower end detachably fitted into the attachment 32 and has a peripheral wall 48 formed with a plurality of air exhaust holes 49. A spring 53 is interposed in its compressed state between a top 51 of the cover member 46 and a flange 52 of the slide member 36 and presses the air exhaust valve 42 underlying the flange 52 against the valve seat 43. The cap 47 is flexible and has its lower part detachably fitted into the cover member 46. The cap 47 protects the regions in which the first and second hoses 23, 24 are connected to the connector members 35, 39, respectively, and the vicinity of these regions. In the air supply and exhaust system 11 of such construction, the air is supplied from the first hose 23 to the interior of the jacket 3 through the main air supply pipe 34.

Figure 4:
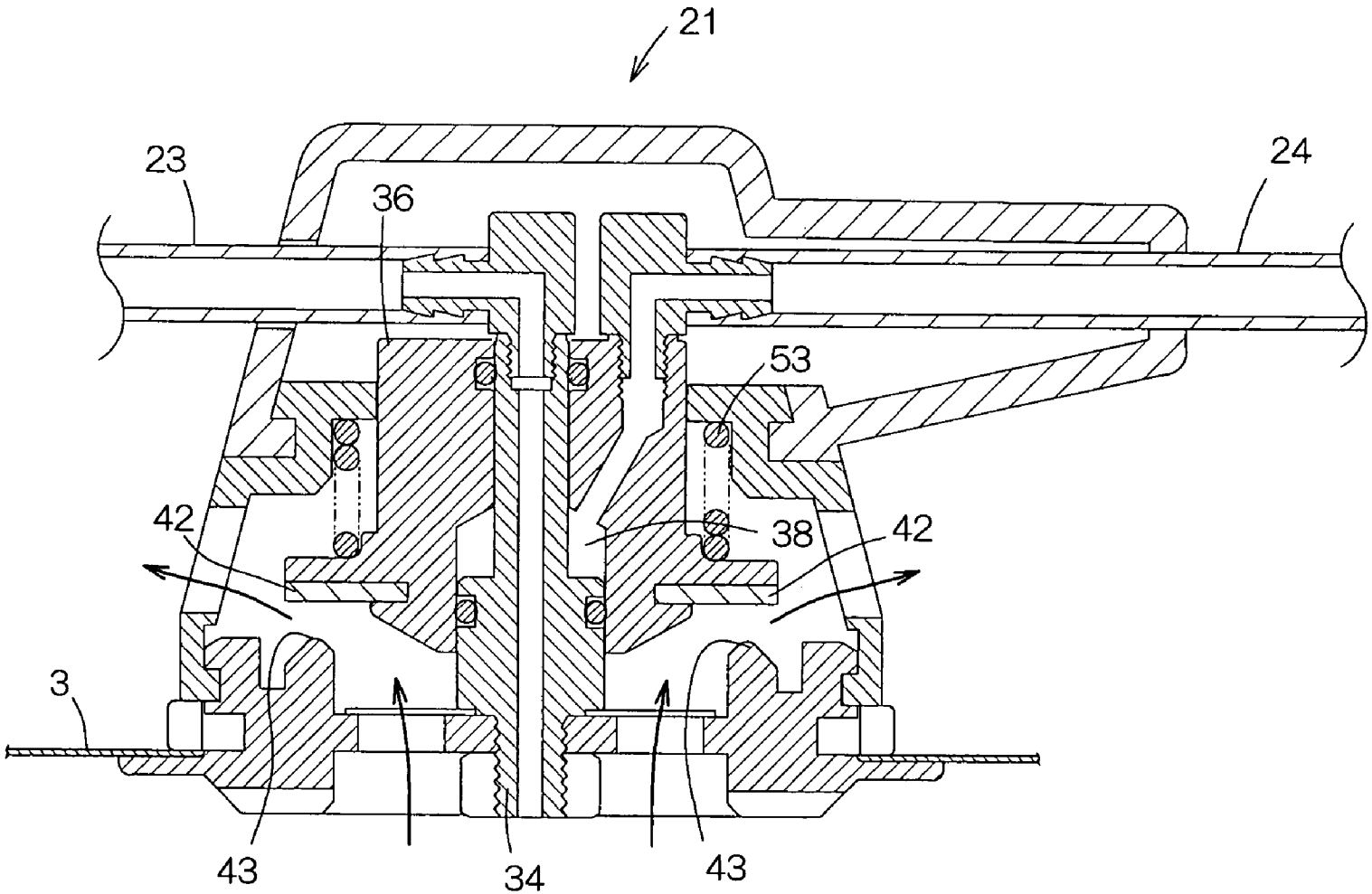
FIG. 4 is a view similar to FIG. 3, illustrating a manner in which a slide member operates.

FIG. 4 is a view similar to FIG. 3, illustrating a manner in which the air supply unit 21 operates when the air is supplied from the second hose 24 into the air chamber 38. The air supplied at high or medium pressure from the air cylinder 4 into the air chamber 38 lifts the slide member 36 against a biasing effect of the spring 53 so as to space the air exhaust valve 42 from the valve seat 43 and thereby allow the air within the jacket 3 to be exhausted in a direction indicated by an arrow.

Figure 5:
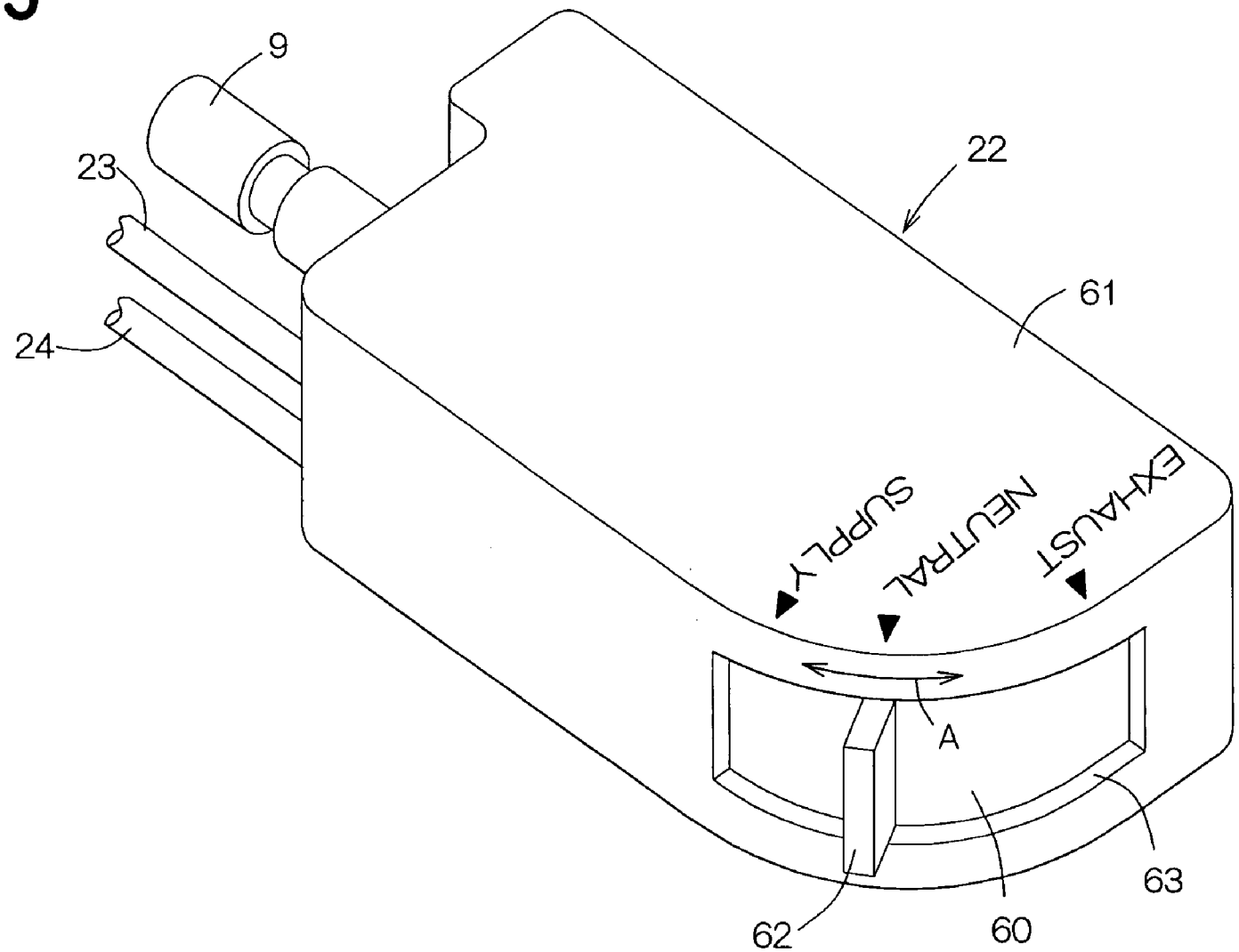
FIG. 5 is a perspective view of a manipulating unit.

FIG. 5 is a perspective view of the manipulating unit 22. The manipulating unit 22 has an outer housing 61 and a change-over switch 60 of which a knob 62 extends outward through an opening 64 of the outer housing 61. The knob 62 may be set to a position indicated by index NEUTRAL or moved in one of directions indicated by a double-headed arrow A and set to a position indicated by index SUPPLY or EXHAUST. Starting from the outer housing 61, the coupler 9 adapted to be coupled to the air hose 8 and the first and second hoses 23, 24 extend leftward as viewed in FIG. 5. These first and second hoses 23, 24 further extend to the sections of these first and second hoses 23, 24 as illustrated in FIGS. 3 and 4.

Figure 6:
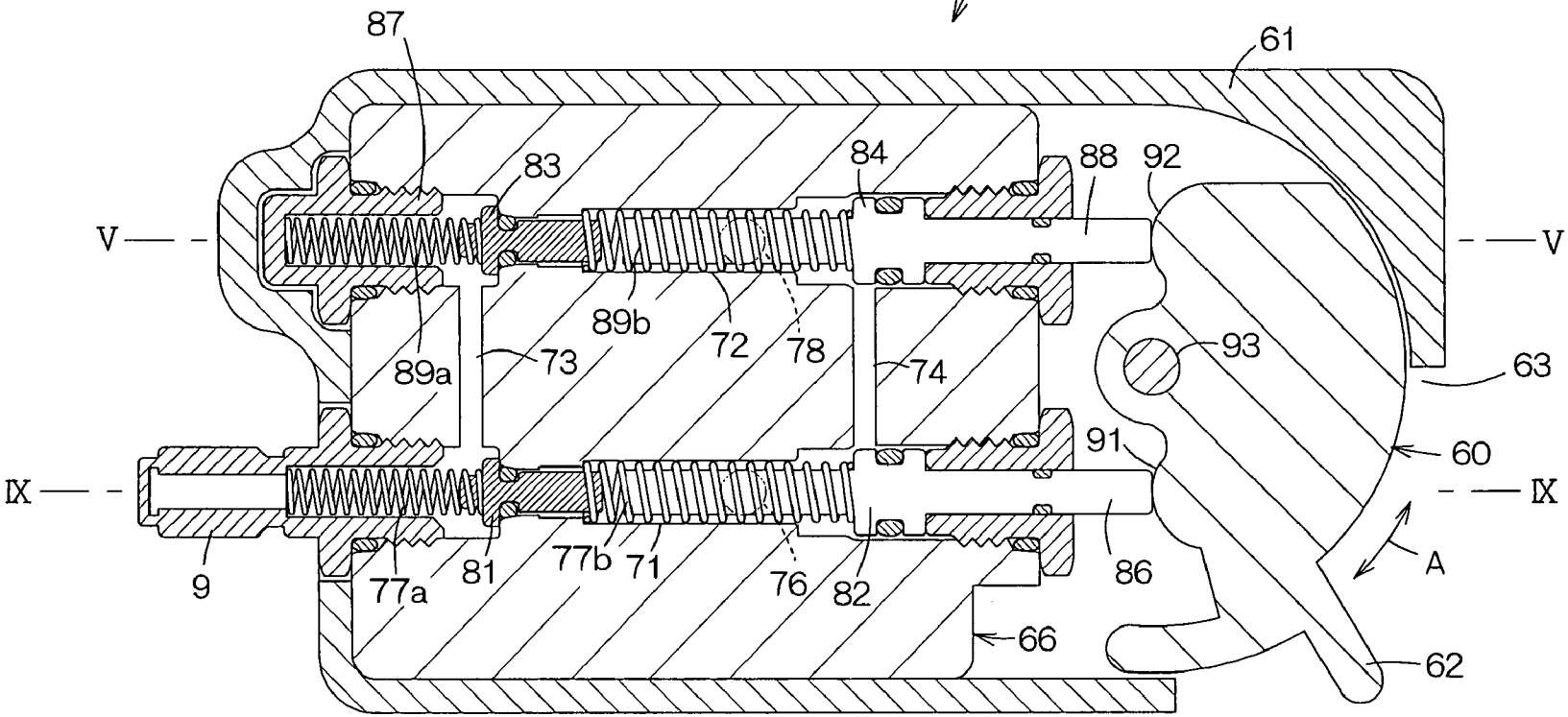
FIG. 6 is a sectional view illustrating the interior of the manipulating unit.

FIG. 6 is a sectional view illustrating the interior of the manipulating unit 22. The manipulating unit 22 has an inner housing 66 within the outer housing 61. The inner housing 66 is formed with first and second vent channels 71, 72 extending in parallel to each other in horizontal direction as viewed in FIG. 6 and third and fourth joint channels 73, 74 adapted to join the first and second vent channels 71, 72 in air-communicating relationship. The first vent channel 71 is provided on its left end with the coupler 9 and open at its right end. An intermediate section of the first vent channel 71 defined between the position at which the channel 71 is connected with the first joint channel 73 and the position at which the channel 71 is connected with the second joint channel 74 is formed with a third vent channel 76 to which the first hose 23 is connected (See FIG. 9). This third vent channel 76 substantially makes a part of the first hose 23 and integrally cooperates with the first hose 23 to form the first air supply pipe. The first vent channel 71 contains therein a first valve 81 and a second valve 82. The first valve 81 normally blocks a path defined between the first joint channel 73 and the third vent channel 76 so that the air can not flow from the air hose 8 into the third vent channel 76. The second valve 82 normally leaves a path defined between the second joint channel 74 and the first vent channel 71 open. The second valve 82 extends in horizontal direction as viewed in FIG. 6 and has its right end 86 extending outward from the inner housing 66. The first valve 81 is normally biased by a first spring 77*a* to be closed and the second valve 82 is normally biased by a second spring 77*b* to be opened.

The second vent channel 72 has its left end provided with a blank cap 87 and its right end left open. An intermediate section of the second vent channel 72 defined between the position at which the channel 72 is connected with the first joint channel 73 and the position at which the channel 72 is connected with the second joint channel 74 is formed with a fourth vent channel 78 to which the second hose 24 is connected (See FIG. 10). This fourth vent channel 78 substantially makes a part of the second hose 24 and integrally cooperates with the second hose 24 to form the second air supply pipe. The second vent channel 72 contains therein a third valve 83 and a fourth valve 84. The third valve 83 normally blocks a path defined between the first joint channel 73 and the second vent channel 72 so that the air can not flow from the air hose 8 into the fourth vent channel 78. The fourth valve 84 normally leaves a path defined between the second joint channel 74 and the fourth vent channel 78 open. The fourth valve 84 extends in horizontal direction as viewed in FIG. 6 and has its right end 88 extending outward from the inner housing 66. The third valve 83 is normally biased by a third spring 89*a* to be closed and the fourth valve 84 is normally biased by a fourth spring 89*b* to be opened.

The change-over switch 60 is formed with a pair of protrusions 91, 92 destined to come in contact with respective ends 86, 88 of the second valve 82 and the fourth valve 84 and supported by a rotary shaft 93 so as to be rotatable in the directions indicated by the double-headed arrow A. It should be noted here that the change-over switch 60 is normally held at the position NEUTRAL (See FIG. 5). This is for the reason that both the end 86 and the 88 biased by the second and fourth springs 77*b*, 89*b*, respectively, are pressed against the protrusions 91, 92.

Figure 7:
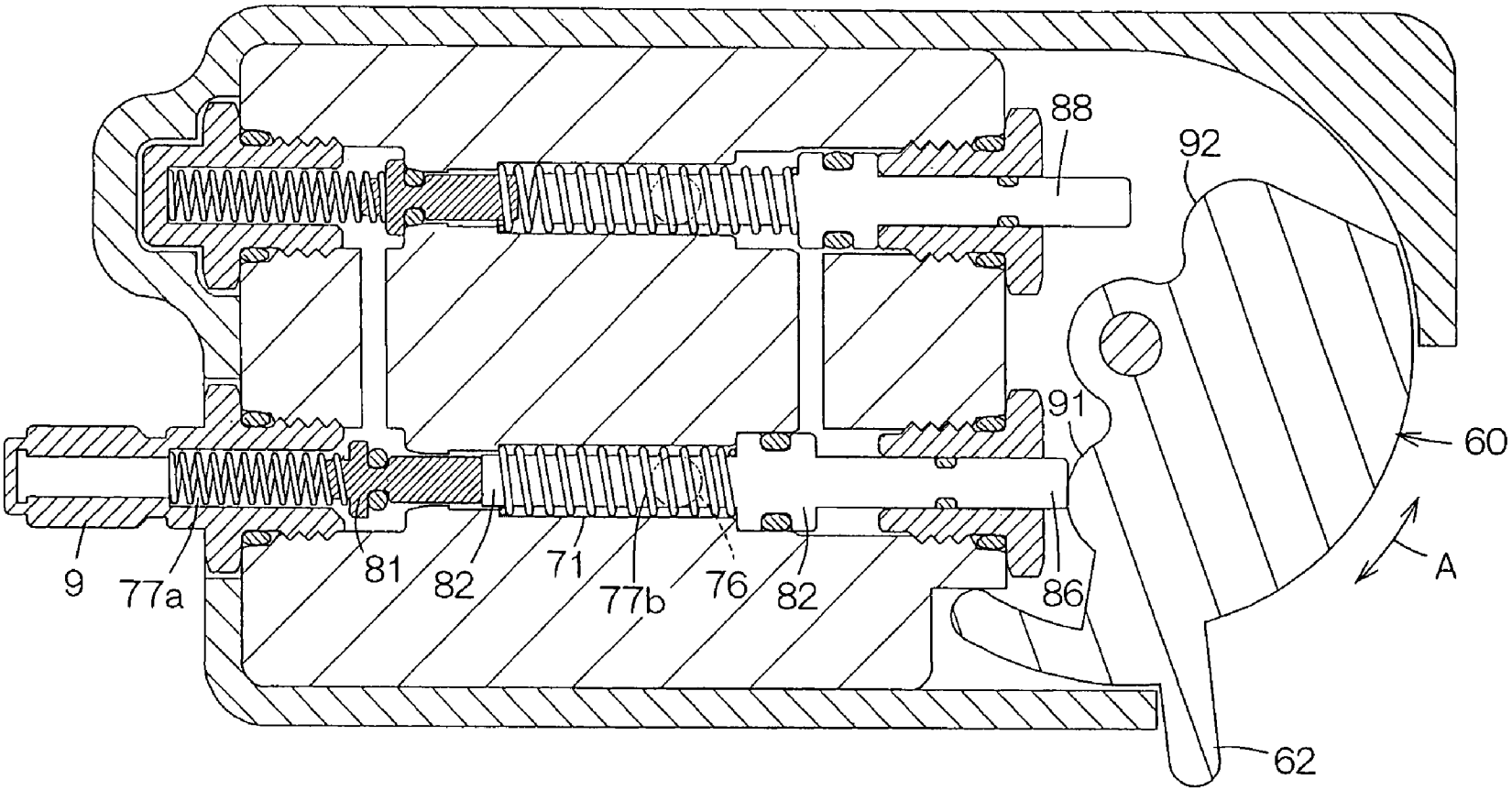
FIG. 7 is a view similar to FIG. 6 illustrating a manner in which first and second valves operate.

FIG. 7 is a view similar to FIG. 6, in which the change-over switch 60 has been clockwise rotated by manipulating the knob 62 to the position SUPPLY. As the protrusion 91 of the change-over switch 60 pushes the end 86 of the second valve 82, the left end of the second valve 82 pushes the right end of the first valve 81 so as to ensure air communication between the first vent channel 71 and the coupler 9. The air flows through the coupler 9 into the first vent channel 71 and then into the third vent channel 76. The air flows through the first hose 23 and is supplied to the jacket 3 via the air supply and exhaust unit 21. Referring to FIG. 7, both the first spring 77*a* and the second spring 77*b* are in compressed state and the second valve 82 and the change-over switch 60 return to the position NEUTRAL as in FIG. 6 under a restoring force of the first and second springs 77*a*, 77*b* as the user's hand is released from the knob 62.

Figure 8:
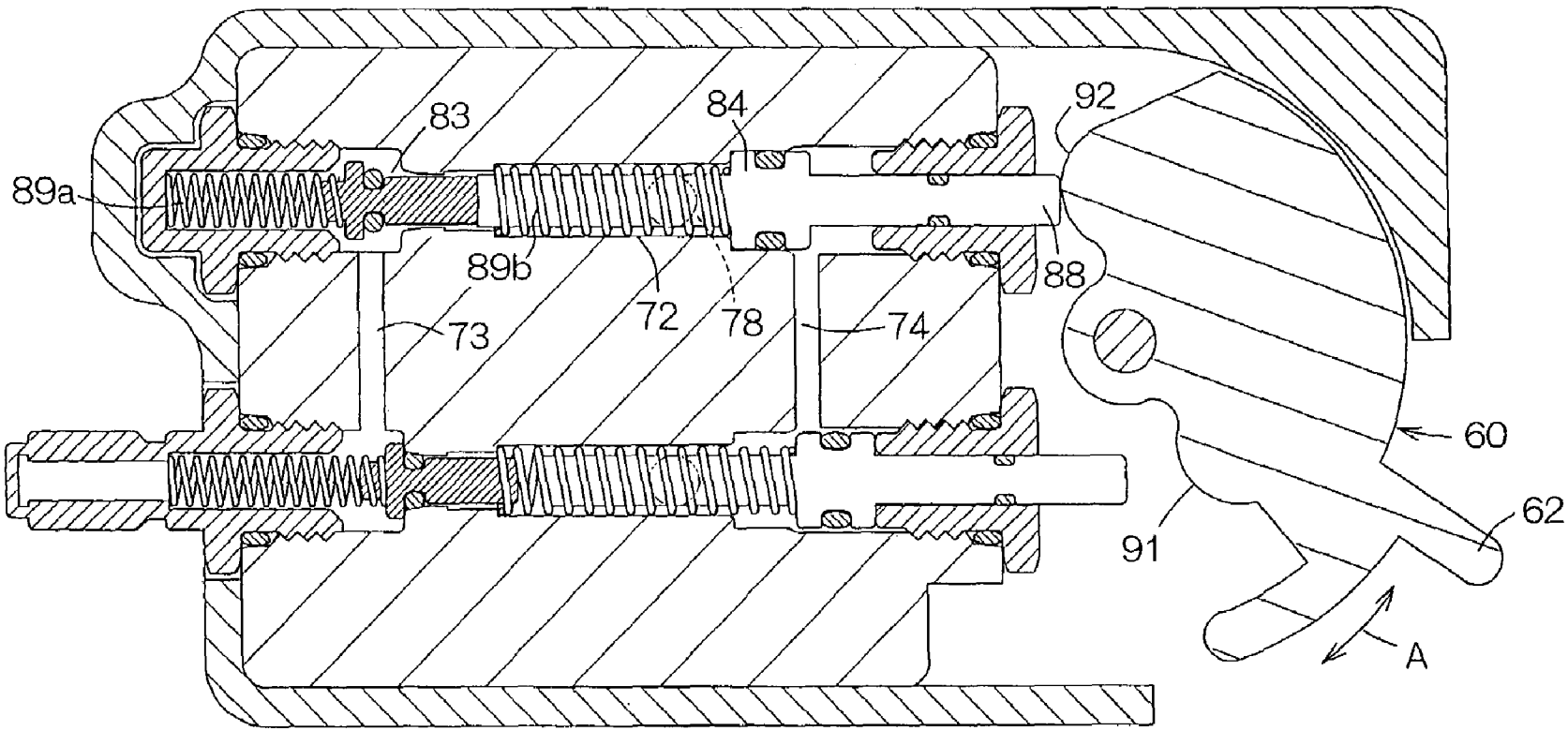
FIG. 8 is a view similar to FIG. 6 illustrating a manner in which third and fourth valves operate.

FIG. 8 is a view similar to FIG. 6, in which the change-over switch 60 has been counterclockwise rotated by manipulating the knob 62 to the position EXHAUST. As the protrusion 92 of the change-over switch 60 pushes the end 88 of the fourth valve 84, the left end of the fourth valve 84 pushes the right end of the third valve 83 so as to ensure air communication between the second vent channel 72 and the coupler 9. The air from the coupler 9 into the fourth vent channel 78 via the first joint channel 73 and the second vent channel 72. The air is supplied through the second hose 24 to the air chamber 38 of the air supply and exhaust unit to ensure the jacket 3 to be air exhausted. Both the third spring 89*a* and the fourth spring 89*b* are in compressed state and the second valve 82 and the change-over switch 60 return to the position NEUTRAL as in FIG. 6 under a restoring force of the third and fourth springs 89*a*, 89*b* as the user's hand is released from the knob 62. Upon closure of the second valve 83, air supply to the air chamber 38 is interrupted and the air within the air chamber 38 can flow into the jacket 3 via the second joint channel 74, the first vent channel 71 and the third air supply channel 76, resulting in closure of the exhaust valve 42 of the air supply and exhaust unit 21.

Figure 9:
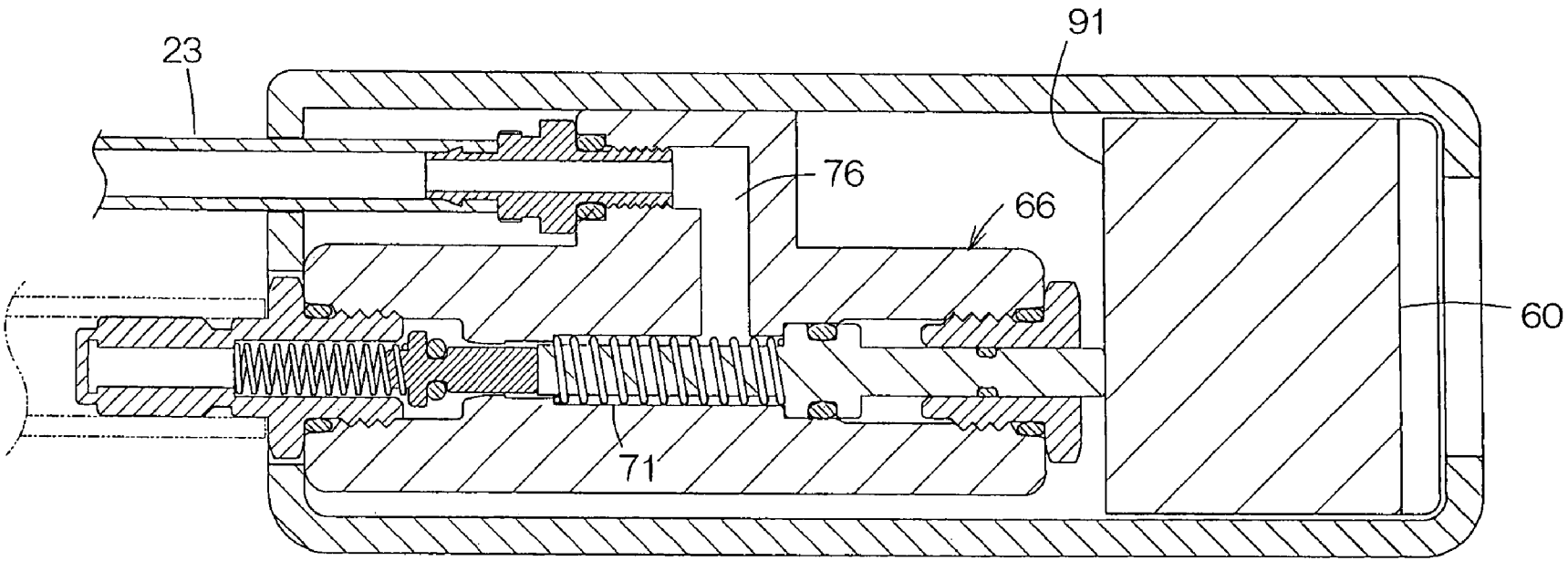
FIG. 9 is IX—IX in FIG. 6.

FIG. 9 is a sectional view taken along a line IX—IX in FIG. 6. From the first vent channel 71 of the inner housing 66, the third vent channel 76 extends upward as viewed in FIG. 9 and is connected to the first hose 23.

Figure 10:
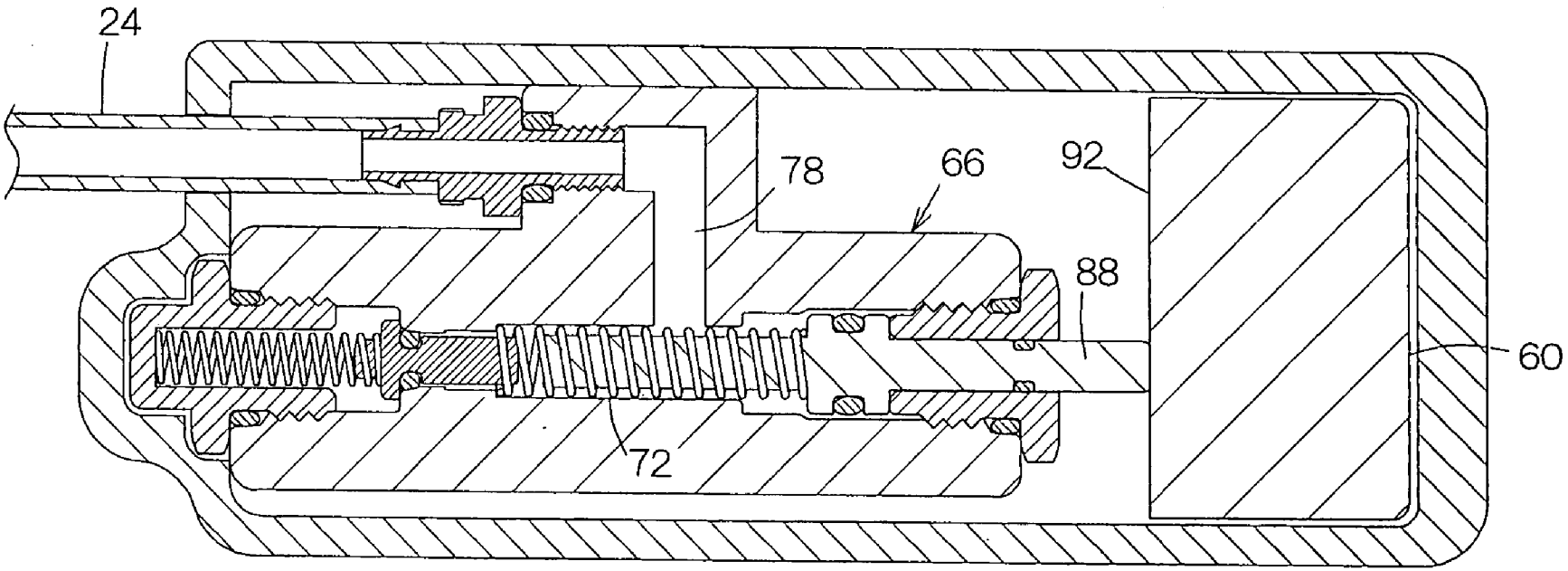
FIG. 10 is a sectional view taken along a line X—X in FIG. 6.

FIG. 10 is a sectional view taken along a line X—X in FIG. 6. From the second vent channel 72 of the inner housing 66, the third vent channel 78 extends upward as viewed in FIG. 10 and is connected to the second hose 24.

With the air supply and exhaust system constructed as has been described above, air supply to the jacket 3 as well as air exhaust from the jacket can be achieved merely by rotating the knob 62 of the manipulating unit 22 in any one of the directions indicated by the double-headed arrow A. In this manner, manipulation for air supply and exhaust is simplified and the diver is not required to be skillful in use of the air supply and exhaust system. Whether the first and second hoses 23, 24 are in proper connection with the air supply and exhaust unit 21 or not can be checked merely by unscrewing the cap 47 and operation of the slide member 36 can be checked merely by removing the cover member 46. In this way, checking of the air supply and exhaust system 11 is effectively facilitated.

The present invention allows for production of the air supply and exhaust system improved so that manipulation as well as checking is simplified.

What is claimed is:

1. An air supply and exhaust system attached to an air bag of a buoyancy compensator, comprising:

an air supply and exhaust unit adapted to control of air supply from an air supply source connected to said buoyancy compensator to said air bag and to control air exhaust from said air bag by opening or closing an air exhaust valve and a manipulating unit adapted to control said air exhaust valve to be opened or closed;

said air supply and exhaust unit being attached to a periphery of an air supply and exhaust opening formed in said air bag and comprises a main air supply pipe fixed to said air bag in air-communication with the interior of said air bag and an air exhaust valve provided closely around an outer peripheral surface of said main air supply pipe so as to be pressed under a biasing effect of a spring against a valve seat formed around said main air supply pipe wherein said air exhaust valve includes a slide member adapted to slide along said outer peripheral surface against said biasing effect of said spring so that said air exhaust valve may be moved apart from said valve seat and thereby to allow for air exhaust from said air bag; and said manipulating unit being adapted to be connected with an air hose extending from said air supply source and comprising a first air supply pipe connected to said main air supply pipe, a second air supply pipe connected to an air chamber formed between said main air supply pipe and said slide member and a rotary change-over switch functioning to change-over a direction of the air flow wherein a rotational position of said change-over switch may be selected to direct said air flow to any one of said first air supply pipe and said second air supply pipe or to interrupt said air flow to these first and second air supply pipes and, in this way, said manipulating unit allows said air to be supplied to said air chamber through said second air supply pipe and thereby allows said slide member to slide against said biasing effect of said spring under a pressure of said air.

2. The air supply and exhaust system according to claim 1, wherein:

said manipulating unit comprises first and second vent channels extending in parallel to each other and first and second joint channels connected to these two vent channels in air-communicating relationship and extending in parallel to each other wherein said first vent channel is formed so as to be connected to said air hose, an intermediate section of said first vent channel defined between its positions at which said first vent channel is connected to said first and second joint channels, respectively, is connected to said first air supply pipe and an intermediate section of said second vent channel defined between its positions at which said second vent channel is connected to said first and second joint channels, respectively, is connected to said second air supply pipe;

said first vent channel contains therein first and second valves adapted to be alternately opened and closed wherein said first valve is interposed between said first joint channel and said first air supply pipe and normally closed to block the air flow from said air hose into said first air supply pipe while said second valve is interposed between said second joint channel and said first air supply pipe and normally opened to connect said second joint channel with said first air supply pipe in air-communicating relationship via said first vent channel;

said second vent channel contains therein third and fourth valves adapted to be alternately opened and closed wherein said third valve is interposed between said first joint channel and said second air supply pipe and normally closed to block the air flow from said air hose into said second air supply pipe while said fourth valve is interposed between said second joint channel and said second air supply pipe and normally opened to connect said second joint channel with said second air supply pipe in air-communicating relationship via said second vent channel; and said change-over switch can be selectively set to a first position at which said second valve is closed, a second position at which said fourth valve is actuated and a neutral third position at which these two valves are left in normal states thereof.

3. The air supply and exhaust system according to claim 2, wherein said change-over switch is normally set to said third position under the biasing effect of said spring and may be selectively set to any one of said first position and said second position against the biasing effect of the spring.

* * * * *